United States Patent [19]

Brewer

[11] 3,993,256

[45] Nov. 23, 1976

[54] WASTE MANGLER SYSTEM AND STRUCTURE

[75] Inventor: John C. Brewer, Salt Lake City, Utah

[73] Assignee: Garbalizer Corporation of America, Salt Lake City, Utah

[22] Filed: Aug. 28, 1975

[21] Appl. No.: 608,716

[52] U.S. Cl. ..... 241/152 A; 241/186 A; 241/188 R; 241/194

[51] Int. Cl.[2] ..... B02C 13/16

[58] Field of Search ..... 241/152 A, 162, 186 R, 241/186 A, 188 R, 189 R, 189 A, 191, 193, 194

[56] References Cited

UNITED STATES PATENTS

| | | | |
|---|---|---|---|
| 1,647,183 | 11/1927 | Leggemann | 241/189 R X |
| 1,871,489 | 8/1932 | Ammon | 241/189 R |
| 1,934,180 | 11/1933 | Fischer et al. | 241/186 R X |
| 2,722,163 | 11/1955 | Cumpston, Jr. | 241/188 R X |
| 3,015,188 | 1/1962 | Reinecker et al. | 241/194 X |
| 3,137,334 | 6/1964 | Steele | 241/186 A X |
| 3,272,515 | 9/1966 | Wood | 241/186 R X |
| 3,342,426 | 9/1967 | Sackett, Sr. | 241/189 R |
| 3,918,649 | 11/1975 | Miller | 241/189 R |

*Primary Examiner*—Granville Y. Custer, Jr.
*Assistant Examiner*—Howard N. Goldberg

[57] ABSTRACT

A waste mangler system, optionally provided with classification means, for processing garbage, municipal waste, and the like whereby to mangle or break up compacted garbage and other materials, break open bags and bales, and otherwise treat the refuse for a flailing-type reduction. The machine is vertically oriented and includes a rotor having rapidly revolving cross-arms, mounted to a central shaft, which are provided with rigid impact blades and flail elements. The impact blades include rearwardly tapered leading edges so that debris may slide outwardly thereon under the action of centrifugal force to approach the area of reduction proximate the flail elements used. The material descending through the drum of the machinery is deposited down to suitable conveyer means that may be coupled to air classification or other means for material separation and further processing.

9 Claims, 4 Drawing Figures

WASTE MANGLER SYSTEM AND STRUCTURE

The present invention relates to refuse reducing systems and, more particularly, presents a waste materials mangler system suitable for breaking open compacted bales, bundles, bags, and other forms of closely compacted refuse materials to thus prepare the materials for further mangling and reduction by means of flailing.

In the past a number of different types of units have been devised for reducing heterogeneous materials as may be found in waste, refuse, municipal waste, household garbage, and so forth. These materials come in many forms, and certain of these forms will include bagged or baled debris which is closely compacted together by means of external, bagged containers or other means.

Prior equipment has proven deficient in processing such materials, since such materials may tend to hang up on certain types of rotating elements, and also because of the fact that diverse bagged materials and bales have proven very difficult to break open and handle in continuous systems.

In the present invention the machine is vertically oriented for gravity feed. This gravity feed is supplemented by an upstream auger which force-feeds the material down into the medial and lower portions of the erect, stationary cylinder of the equipment.

A series of cross-arms, having leading edges that are rearwardly tapered, are provided with external flailing elements the latter of which actually flail or break up materials fed to the flail areas into very small constituent parts. The rigid, impact blades or arms themselves operate to break into bales and bags so as to commence a preliminary separation and breaking up of materials, so that flail chains, when employed, can be effective for final reduction. It is essential that the rigid blades be included, with their length being at least one-half the distance between the central axis of the central revolving shaft of the equipment and the inside surface of the cylinder or drum.

In a preferred form of the invention the drum is provided with a hardened steel or other impact surface which will be highly resistant to wear, notwithstanding the action of the flail chains thereon and against the broken-up materials.

The material thus flailed will be brought as small particles onto a conveyer, for subsequent routing to an air classification system or other means.

The above invention is extremely suitable for handling many types of diverse materials, and especially baled and bagged materials which must be preliminarily broken up prior to desired reduction.

Accordingly, a principal object of the present invention is to provide a new and improved waste materials mangler system for breaking up and reducing heterogeneous materials therein.

A further object is to provide mauling equipment which will tear into and break open bags, bundles, and bales of waste materials prior to their constituent reduction.

A further object is to provide a vertically oriented machine, requiring a minimum of floor space, for processing by force-feed as well as gravity, diverse waste materials including baled and bagged products, such that compacted materials may be preliminarily broken up by rigid arms prior to the end flail elements of the equipment, further reducing the constituent items.

An additional object is to provide a mangler structure for processing waste materials and refuse of various types prior to the air classification or other sorting of materials, for further processing.

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

Figure 1:
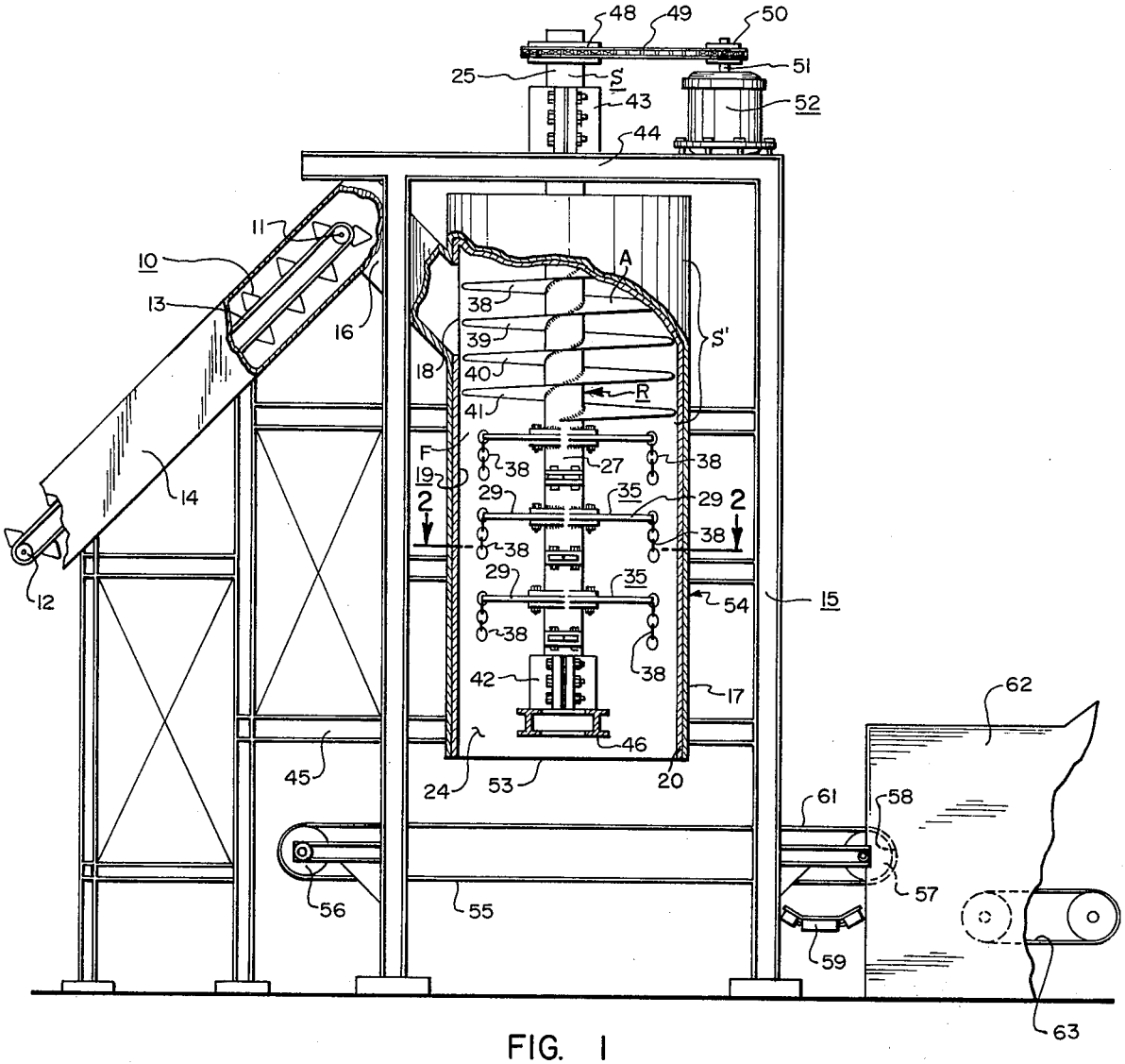
FIG. 1 is a side elevation, partially broken away and sectioned, of a mangler system incorporating the structure of the present invention.
Figure 4:
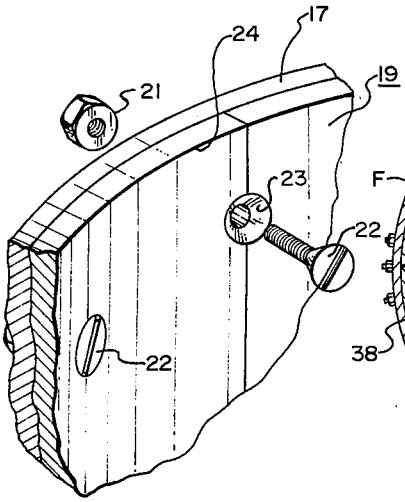
FIG. 4 is an enlarged fragmentary perspective view indicating the means of securing the wear-resistant liner to the inner surface of the stationary drum or cylinder of the equipment.
Figure 3:
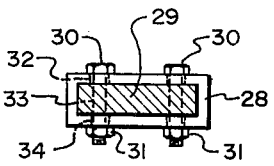
FIG. 3 is an enlarged section taken along the line 3—3 in FIG. 2.

In the drawings, see especially FIG. 1, feed conveyer 10 is supported between rollers 11 and 12, and they comprise any one of the several standard conveyers such as endless rubber conveyers having transverse cleats, chain-and-bar type conveyers having raised bars, and so forth. The particular form of feed conveyer employed, standing alone, forms no part of the invention. Also, the feed conveyer 10 may have, if desired, and in addition to the endless conveyer member 13, a surrounding shroud 14. The latter is optional. Support structure 15 may support the feed conveyer structure as well as a hopper 16. Hopper 16 is connected to and communicates with the interior of a fixed drum 17. The latter is fixedly supported in place by support structure 15 and includes a side access opening 18. A hardened steel or other type abrasion-resistant liner 19 preferably comprises a series of arcuate plates disposed against the inner side wall of drum 17. These may be secured at their respective upper and lower edges by nut and bolt attachments 21 and 22. The heads of the bolts 22 may be countersunk at 23 into the several liner segments. The segments may be any dimension and comprise any number of segments aligned and passing top to bottom relative to the drum. The essential point is that there be provided a hardened flail surface 24 that will not be subjected to excessive abrasive wear through employment of the flail structure, hereinafter described. Shaft 25 forms part of rotor R and is provided with a series of radially extending spider sockets 28. The latter individually receive the rigid arms or impact blades 29. The manner of securement is shown in FIG. 3 wherein it is seen that these arms are secured within their respective sockets 28 by bolt and nut attachments 30 and 31, apertures 32-34 being provided at each of two places for the respective sockets. Most importantly, each of the rigid impact blades 29 of cross-arm flail structures 35 has a rearwardly tapered forward edge 36 and an end attachment 37 such as a U-bolt lock or other structure which secures a flexible flail length or element 38, preferably a chain, in place. These flail lengths may simply comprise standard link chains of a hardened steel variety.

The series of the cross-arm flail structures 35 are seen in FIG. 1 to be fixedly disposed onto the shaft 25.

Likewise made up on the vertical shaft structure S of rotor R, as indicated, is an auger A formed of a contiguous series of auger blade segments 38–41. The auger blade segments may be either separate or of integral and unitary construction and in any event will operate like the standard auger in a meat grinder or other type of auger-feed mechanism. Thrust bearings 42 and 43 are provided and are secured by any conventional means to fixed structures 44 and 45 in the usual manner. The structure at 46 supports and fixes bearing 42 in place. The upper end of the composite shaft S, comprising essentially shaft 25, is provided with a drive sprocket 48. The latter engages drive chain 49 of sprocket 50. The latter sprocket is keyed to output shaft 51 of drive motor 52.

Disposed beneath the discharge end 53 of the reducing structure 54 is a conveyer belt 55, the same being supported and driven at opposite ends by rollers 56 and 57. Roller 57 may be a magnetic roller, and disposed beneath the forward end 58 is found a transverse conveyer 59; the purpose of the conveyer 59 is to convey away magnetic materials that are carried by the combination of the belt 61 and magnetic roller 57 around the end 58 and which drop onto conveyer 59. The remaining material will drop into an air classifier unit 62, similar to that shown in the inventor's U.S. Pat. No. 3,856,217. From the air classifier, one or more material types may be carried away by one or more conveyers 63, as disclosed in the aforementioned patent application which is fully incorporated herein by way of reference.

An essential feature of the present invention is the manner in which municipal waste, for example, is broken up and reduced preparatory to conveyance to magnetic separators, an air classification system, and so forth.

Figure 2:
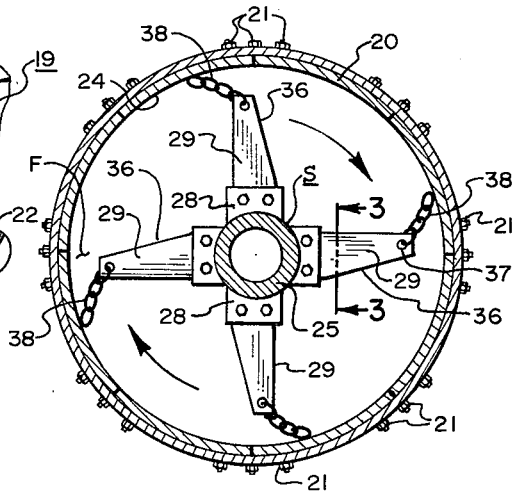
FIG. 2 is a transverse horizontal section looking down and taken along the line 2—2 in FIG. 1.

The structure as shown in FIGS. 1–3 operates as follows. Material is fed by the feed conveyer 10 into hopper 16 to enter into the interior of the cylindrical structure or drum 17 and, particularly, interior of the liner thereof at 20. The material is force-fed downwardly through area S′ by the series of auger blades 38-41 so as to enter the area including cross-arm flail structures 35, three being shown by way of example. The composite shaft structure S will revolve extremely rapidly so that any compacted materials, bags and packages, will be force-fed downwardly by the auger A, comprised of auger segments 38–41, into flail area F. It should be emphasized that the reduction means structure in the area F are not merely the flail chains, but, and most important, the entire cross-arm flail structures 35 which importantly include the rigid impact blades 29 having rearwardly tapered leading or forward edges 36. These rigid blades are for the purpose of impacting and hence cutting through or tearing to shreds any bags of garbage or debris, compacted bales, and other forms of impacted or matted material. After such materials are initially broken up, then centrifugal force, acting in combination with the tapered edges 36 of the blades, will urge such materials outwardly in the proximity of the rapidly traveling flail chains or elements 38. These chains 38 serve to flail, break, or reduce these materials into very fine components which are sufficiently reduced for total processing. Such chains will not damage the interior of the drum structure 17 since the inner cylindrical liner as at 19 is provided.

Any material thus introduced at 18 proximate the auger will be forced thereby into the cross-arm and flail area and, when reduced, will fall onto conveyer 61, where the same advances toward magnetic roller 57 for ferrous-material separation via conveyer 59. The remaining material will be sufficiently reduced for proper injection into the air classification system at 62, a certain portion or portions thereof being conveyed outwardly by conveyer 63. The remaining materials may be blown into separate compartments and separately conveyed in accordance with the inventor's prior U.S. Pat. No. 3,856,217.

Of importance is the unique feature of having a machine in essentially vertical disposition which by its nature will take up a minimum of floor space. Such machine is useful to effect not only an auger force-feed but also the combination of a breaking up of bags, bundles, and other compacted material, via the blades 29 and the conveyance outwardly of such materials in accordance with the provision of tapered leading edges 36 so that the flail chains at 38 may be useful at last to reduce the so broken up materials, to essentially reduced form capable of air classification, magnetic separation of ferrous materials, and so forth.

In addition to the flailing reduction of materials contributed by the flexible, elongate flail elements, an additional primary purpose of these flail chains is to permit passage of materials downwardly through the drum and circumferentially about the rigid impact arms aforesaid, without jamming the equipment. Finally, the materials access opening leading to the auger may be disposed thereabove instead of at the side of the drum as shown at 18 in the drawing.

While particular embodiments of the invention have been shown and described, it will be obvious to those skilled in the art the various changes and modifications which may be made without departing from the essential features of the present invention and, therefore, the aim in the appended claims is to cover all such changes and modifications as fall within the true spirit and scope of the invention.

I claim:

1. Waste mangler structure including, in combination, essentially vertically disposed cylindrical structure, and a rotor journalled for rotation centrally within said cylindrical structure, said rotor having auger means cooperable with said cylindrical structure for forcefeeding received materials downwardly within said cylindrical structure, said rotor also having rigidly affixed cross-arm means disposed beneath said auger means for impact-loosening and reducing compacted materials received from said auger means, and drive means coupled to said rotor for revolving the same, said cross-arm means comprising a series of inner, impact ripper blades and a series of outer flail chains respectively secured to said impact ripper blades.

2. The structure combination of claim 1 wherein said cylindrical structure is provided with cross-brace support means for supportingly journalling said rotor at a lower extremity thereof.

3. The structure of claim 1 wherein said cylindrical structure includes a side access opening proximate said auger means, and a hopper secured to said side access opening.

4. The structure of claim 1 wherein said rotor includes a central shaft, said cylindrical structure having thrust bearing means supportingly journalling said central shaft for central axial rotation within said cylindrical structure.

5. The combination of claim 1 wherein said rotor has transverse pocket structures, said ripper blades being seated within and secured to said pocket structures.

6. The combination of claim 1 wherein said rotor comprises a shaft having a longitudinal axis, said cross-arm means comprising a series of mutually vertically spaced cross-arm structures having said impact ripper blades secured to said shaft and extending radially outwardly therefrom a distance at least one-half the distance from the axis of said shaft to said cylindrical structure, said flail chains being secured to said impact ripper blades proximate the outer extremities of said impact ripper blades.

7. The structure of claim 6 wherein said impact ripper blades have leading edges which are outwardly tapered rearwardly.

8. In combination, a tubular structure having a feed end and a discharge end, a rotor centrally journalled within said tubular structure and having a longitudinal axis of revolvement, said rotor including an auger proximate said feed end and cooperable with said tubular structure for positively advancing materials fed into said feed end in a direction toward said discharge end, said rotor also being provided with radially extending rigid arms downstream from said auger and having outer extremities and also flexible elongate flails secured to said rigid arm outer extremities, the overall length of said arms with said flails exceed the distance between said longitudinal axis and said tubular structure, whereby said flails can impinge against said tubular structure.

9. The combination of claim 8 wherein said arms have rearwardly tapered leading edges.

* * * * *